United States Patent [19]

Attar

[11] Patent Number: 4,726,706

[45] Date of Patent: Feb. 23, 1988

[54] REFLECTIVE PAVEMENT MARKER

[76] Inventor: Adil H. Attar, 8717 E. Fairview Ave., San Gabriel, Calif. 91775

[21] Appl. No.: 869,289

[22] Filed: Jun. 2, 1986

[51] Int. Cl.[4] ..... E01F 9/06

[52] U.S. Cl. ..... 404/14; 404/16; 350/103; 116/63 R

[58] Field of Search ..... 404/14, 16; 350/97-103; 116/63 R

[56] References Cited

U.S. PATENT DOCUMENTS

| | | | |
|---|---|---|---|
| 3,332,327 | 7/1967 | Heenan | 350/103 X |
| 3,516,337 | 6/1970 | Gubela | 404/16 X |
| 3,519,327 | 7/1970 | Nakajima | 404/14 X |
| 3,762,825 | 10/1973 | Reusser | 404/16 |
| 3,822,158 | 7/1974 | Hoffman et al. | 404/16 X |
| 3,984,175 | 10/1976 | Suhr et al. | 350/103 |
| 4,076,383 | 2/1978 | Heasley | 404/14 X |
| 4,208,090 | 6/1980 | Heenan | 404/14 X |
| 4,232,979 | 11/1980 | Johnson, Jr. et al. | 404/16 |
| 4,340,319 | 7/1982 | Johnson, Jr. et al. | 404/16 |
| 4,498,733 | 2/1985 | Flanagan | 404/14 X |

FOREIGN PATENT DOCUMENTS

| | | | |
|---|---|---|---|
| 2147038 | 5/1985 | United Kingdom | 404/16 |

*Primary Examiner*—James A. Leppink
*Assistant Examiner*—John F. Letchford

[57] ABSTRACT

A retro-reflective roadway marker is generally comprised of a one-piece housing, having integrally molded retro-reflective faces.

The reflective faces having outside surfaces with abrasing reducing raised members and inside surfaces of light reflecting elements that are preferably formed from three mutually intersecting surfaces.

In one form the reflective elements within the housing are integrally molded with partition walls, dividing the reflective elements into small cells, each cell with a plurality of the reflective elements functioning independently without being encapsulated by the filler material.

6 Claims, 9 Drawing Figures

REFLECTIVE PAVEMENT MARKER

BACKGROUND OF THE INVENTION

This invention relates to raised pavement markers that utilize a plurality of light reflecting prisms each with three intersecting surfaces.

This type of raised marker have been used extensively, especially the types with the reflective cube corner elements.

Roadmarkers are mounted on the pavement along the edgeline, centerline or as lane dividers. Markers of this type are usually made of either one-piece or two-piece housing, made of compatible thermoplastic materials with at least one metalized reflective face. Prior to filling the entire housing with a plastic material for rigidity and strength, the reflective portion of the housing are coated with a metalized layer to retain part of its retro-reflective ability. This metalization process, although retaining part of the retro-reflective ability of the three intersected surfaces of the prisms, it also retards portions of the light reflecting out of the three surfaces of the reflecting prisms.

Experience has also proven that the smooth exterior surfaces of the reflecting faces of the markers oriented at an acute angle with the road surface tend to reduce its reflective ability shortly after usage, due to the action of dirt with tire passage.

Among the objectives of this invention are to offer a pavement marker which has an enhanced reflectivity, abrasing reducing raised element which is integrally part of the housing; enlarged reflective faces; and, low cost. Furthermore, this invention enhances the outside angular configuration of the pavement marker to reduce the protrusion from the roadway, thereby reducing impact shocks to the passing vehicles.

SUMMARY

The primary objective of this invention is to provide an improved pavement marker of the type consist of one piece shell formed with reflective faces, the reflective faces metalized and entire shell filled with organic material for strength. This has been achieved by developing integrally molded housing, having one or two opposing faces with light reflecting elements, each reflective face is integrally divided into rhombic shaped cells. Each cell contains a planar surface on the outside to intercept light from oncoming vehicles and either a single reflective element or plurality of reflective elements within the inside surface of each rhombic shaped cell. The rhombic shaped cells are isolated from each other by slightly raised members on the outside surface and by a corresponding partition walls from the inside surface. A backing sheet adhered onto said partition walls, seal and isolate each cell, freeing the three surfaces of the reflecting elements within each cell from encapsulation by the filler material. Hence, the reflectivity achieved without vacuum metalizing the reflecting elements.

Another objective of this invention is to provide an improved pavement marker of the type using load carrying partition walls. This has been achieved by incorporating on the outside surface of the reflective face slightly raised members and nearly directly above the partition walls, thereby freeing the reflective cells from direct impact and permitting light impinging on the outside surface of the reflective cells to bounce back freely toward the vehicle line of sight.

Another objective of this invention is to provide an improved reflective highway marker utilizing multi-angled sides of relatively simple design, yet protrude a slight amount from the roadway surface, thereby reducing the vehicles' impact upon tire contact with said marker.

Still another objective of the present invention is the enhanced area of the reflective faces which can provide greater area of reflectivity than presently is achieved.

DESCRIPTION OF THE PREFERRED EMBODIMENT

Figure 1:
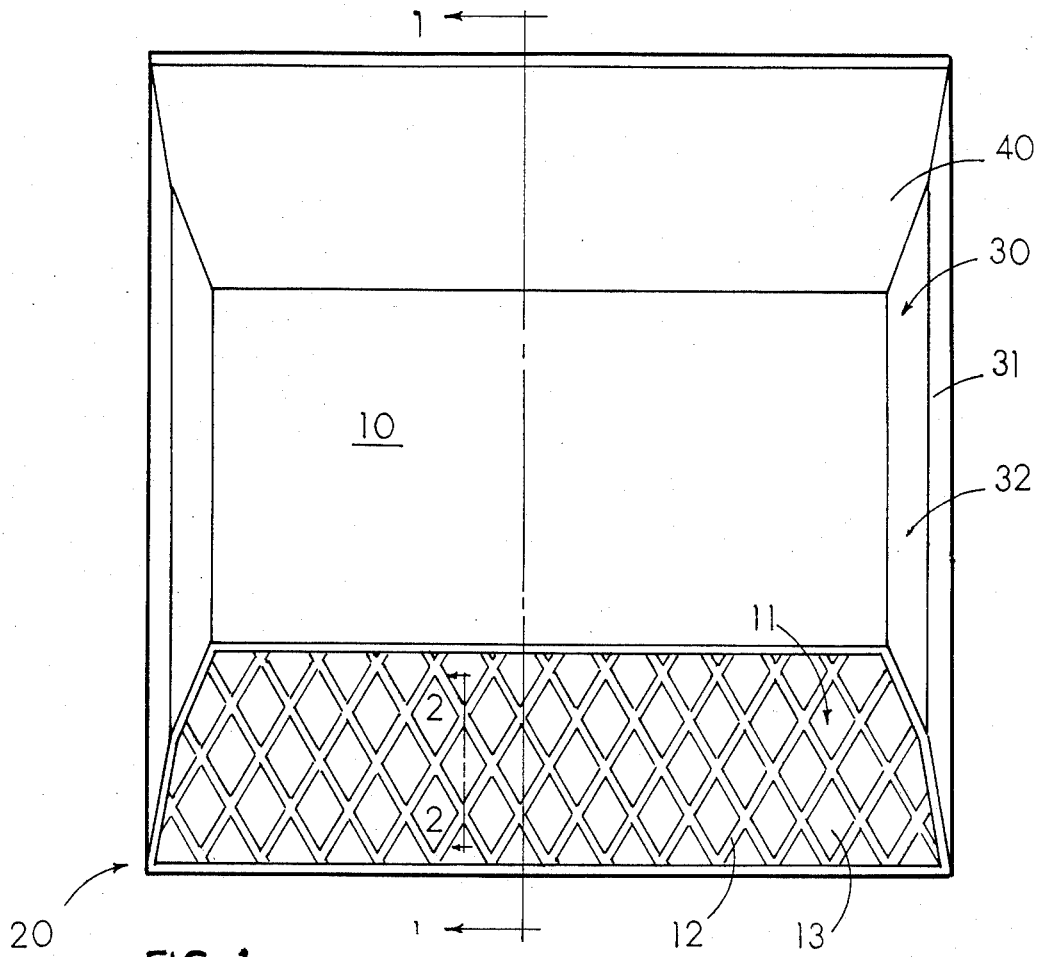
FIG. 1 is a plan view of one embodiment of the pavement marker of this invention.

Greatly enhanced reflectivity and durability for pavement markers can be achieved by the elimination of the process of metalizing the reflective elements of the present pavement markers and by incorporating raised members on the outside of the reflective faces to reduce direct contact, thereby reducing abrasing to the outside planar faces of said pavement marker.

This invention satisfies the above conditions.

Referring to the illustrated drawings of this invention, FIGS. 1 through 4C represent a pavement marker generally designated by the number 20, and comprises a housing 10, a backing sheet 50 and a rigid core 60. Part of the housing 10 is the planar face 11, having an outside surface with abrasing reducing and load transferring members 12 defining the planar surfaces 13 of the rhombic shaped cells, adopted to intercept light.

The inside surface of face 11 is divided into rhombic shaped cells 14, corresponding to planar surfaces 13 on the outside of face 11.

Each cell 14 incorporates either a singular or plurality of reflective elements 16. Cells 14 isolated from each other by partition and load carrying walls 15. The reflective elements 16 comprise cube corner reflective prisms. Each of the reflective surfaces of an element 16 positioned with respect to the wall 15 in such a particular manner to allow maximum reflectivity of the three reflective surfaces. The axis for each cube corner element form an acute angle i with the normal to the outside surface of the reflective face as in FIG. 3.

Figure 2:
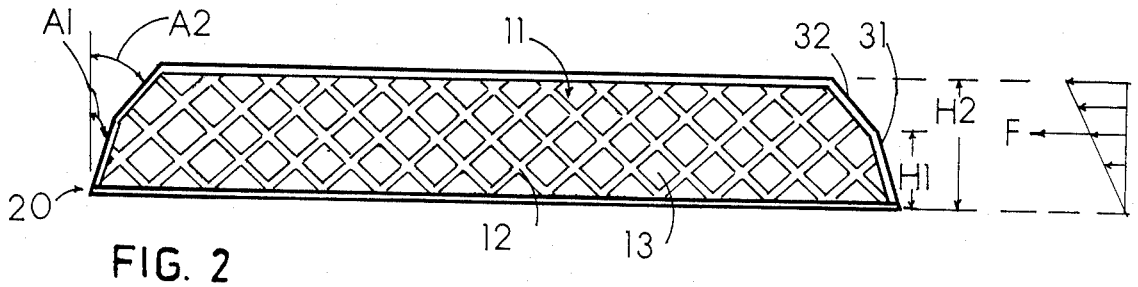
FIG. 2 is an elevation view of the pavement marker of FIG. 1

The housing 10 has side walls 30, each with two segments 31 and 32. FIG. 2 shows each of the segments 31 and 32 to be inclined with distinct angles $A_1$ and $A_2$ with respect to the vertical. Angle $A_1$ preferably within the range of about 5° to 15° and angle $A_2$ is within the range of about 15° to about 60°.

Due to this angular configuration of side 30, the tire impact force F in FIG. 2 will be reduced. This will be accomplished especiallly when the tire impact force F in FIG. 2 is due to traffic lane changes, which is the most frequent vehicular contact to pavement markers. This impact reduction primarily is due to the much lower contact height ($H_1$) instead of height ($H_2$) in FIG. 2.

The housing 10 of the pavement marker 20 may be fabricated from any suitable light-transmitting, impact and weather resistant material. The desired color can be achieved by pigmenting either all or part of the housing 10.

When desired, the pavement marker of FIG. 1 can be bi-directionally reflective by making the opposite face 40 optically equivalent to the reflective face 11.

Figure 3:
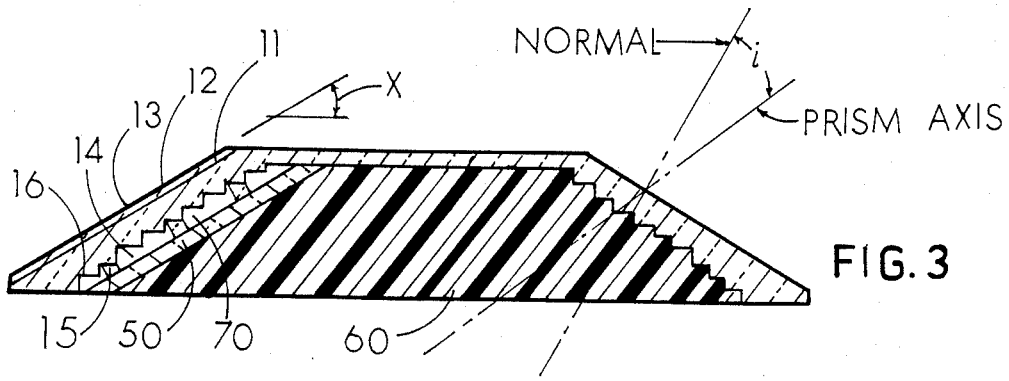
FIG. 3 is a section through Line 1—1 on FIG. 1.

FIG. 3 illustrates a sectional view showing a preferred construction of the pavement marker 20, the outer one-piece housing 10 which is made of a light transmitting organic resinous material. The entire inside portion of the reflective face 11 is sealed with a planar backing sheet 50, made of organic resinous material, then the entire housing 10 is filled with a rigid or resilient material to form core 60.

By using a thermosetting material like Epoxy to fill the core 60, it will provide a rugged structure that adheres well to the interior of housing 10 and the inside of backing sheet 50. Also the present marker will withstand vehicular impact on the roadway.

Since the reflective faces 11 and 40 can be identical in fabrication, we will describe face 11 only in detail.

Figure 4A:
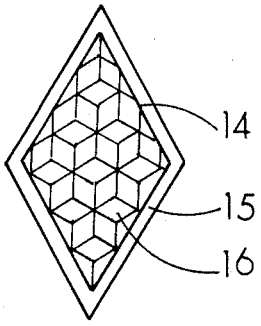
FIG. 4A is a plan view of a preferred form of a rhombic shaped cell housing plurality of cube corner array, within the cell's partition walls.
Figure 4B:
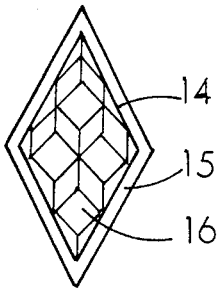
FIG. 4B is another form of a rhombic shaped cell housing the cube corner elements within the partition walls.
Figure 4C:
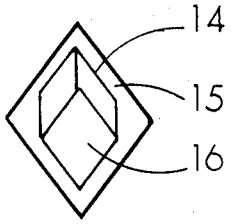
FIG. 4C is a third form of a rhombic shaped cell housing a single cube corner reflector within the partition walls.

The inside surface of reflective face 11 in FIG. 3 is integrally divided into plurality of rhombic shaped cells 14 by the partition walls 15 that extend beyond the tips or raised corners of all of the three mutually intersecting surfaces of the reflective elements 16 within each cell, thereby freeing all of the reflective elements from contact with the backing sheet 50. This creates an air space 70 between the reflective elements within each cell and the backing sheet 50, thereby allowing total reflection within the three intersecting surfaces of each reflective elements 16 without the need to metalize these reflective surfaces prior to filling housing 10 with a rigid material. FIG. 4A 4B and 4C show the preferred forms of the rhombic shaped cell 14 within inside surfaces of the reflective face 11 of housing 10. The size and number of the cube corner element 16 in a given rhombic cell is determined by the particular application of the marker and by the size of the load carrying partition walls used.

A brief background into how a non-metalized reflective cube corner elements or other reflective prisms would reflect light more effectively when they are freely functioning in an air medium (rare medium), instead of being coated with a metal layer.

Figure 5:
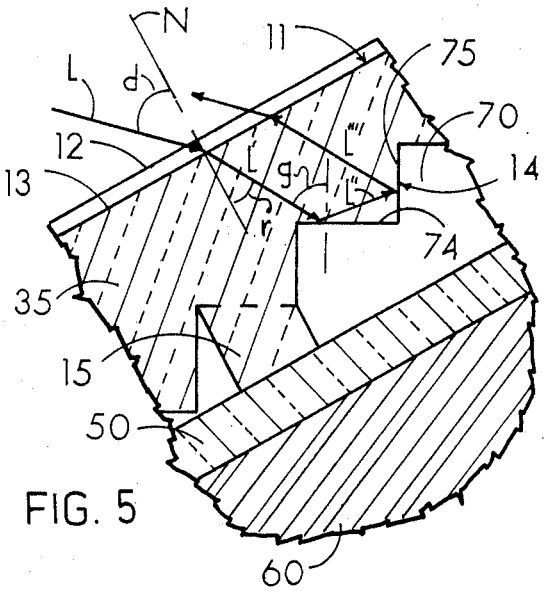
FIG. 5 is an enlarged portion of a segment of the reflective face that may be used in FIG. 1, showing relation between the incident light and the reflected light through free standing reflected element.

FIG. 5 shows the relation between the so-called Poynting vectors L and L' where the vector L represents an incident of light from an oncoming vehicle and L' represents the incident of light traveling through the dense medium 35 of the face 11 that is made of a light transmitting organic resinous material having a predetermined reflective index n=1.5.

Hence, in our case: $n=1.5=\sin d/\sin r$ Where d is the angle that the incident of light ray L forms with the normal line N to the outside surface of face 11 of the housing 10, and r is the angle that deflected light vector L' forms with the same normal line N within the dense medium 35 of face 11 of housing 10.

The mathematical relationship of vectors L, L', angles d and r and the reflective index n has been fully described in the text book (*Introduction to Modern Optic.* by Grant R. Fowles, published by Holt, Rinehart and Winston, Inc., 1968, pp. 47–58).

The author proved that vector L' as in FIG. 5 bounce back at the surfaces 74 and 75 which forms the boundary limits of the light transmitting dense medium 35, just as it reaches rare medium 70. This means that nearly total internal reflection takes place within the inner boundaries 74 and 75 of each reflective element 16 within a cell 14, that is light L' will turn around and bounce back within the dense medium 35. This is known as internal reflection.

Figure 6:
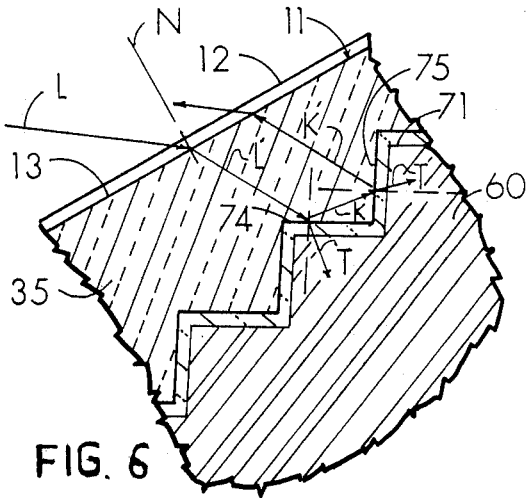
FIG. 6 is the same enlarged portion in FIG. 5 showing the relation between incident light and reflected light through metal coated reflective elements.

FIG. 6 shows that when using the same reflective elements 16 with coated metal backing 71, the incident of light traveling through the light transmitting medium 35 of face 11 as it reaches the outer boundary 74 of the reflective elements 16, partly will be reflected onto the adjacent surface 75 and partly be absorbed by the metal coated surface 71, as indicated by the vectors T, K and T', K'. This is due to the face that the coated metal layer 71, which is usually aluminum, is a more dense medium than the light transmitting reflective elements that are part of the housing medium 35.

Therefore, it has been proven that light vector L'=L''' is greater than (K'). Where K' represents the ray of light bouncing back towards its origin, after partly being absorbed by the metalized surface 71 in FIG. 6 and L''' represents ray of light in FIG. 5, fully reflected on the surfaces 74 and 75 due to the uncoated free standing rare medium 70 behind it.

The above author indicates, however, that there is a critical value for the angle g in FIG. 5. In order to achieve total internal reflection of the incident of light passing through the free standing surfaces of the reflective elements 16, within a cell 14, the angle g has to be greater than the critical angle for the respective material used to fabricate the reflective face 11.

Another primary function of partition walls 15 and the corresponding raised member 12 which are integrally part of face 11 is to function as load carrying walls. The rhombic shaped configuration of these walls form a truss like rigid structure that act uniformly, transfer impact load evenly to the core and free reflective cell 14 from direct impact load.

Figure 7:
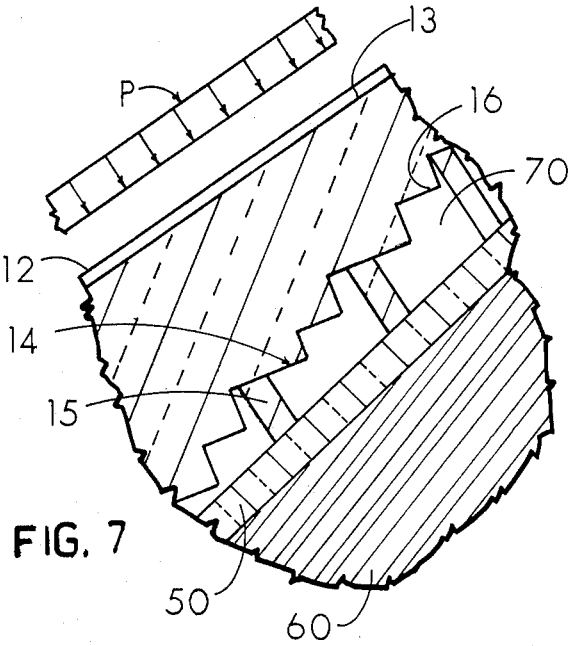
FIG. 7 is a fragmentary section view along the line 2—2 of FIG. 1.

In FIG. 7 the distributed load P acting on face 11, due to vehicular tire impact will be first acting on the abrasing reducing members 12 which are part of the outside surface of face 11. These raised elements 12 will be nearly directly above the corresponding partition walls 15 on the inside surface of face 11, thereby transferring the bulk of impact load P to the core 60 via the aglotinated backing sheet 50.

Another advantage of incorporating the rhombic shaped abrasing reducing elements 12 is to allow a reduction of angle (X) that face 11 forms with the horizontal (as shown in FIG. 3) without increasing the vehicular tire contact with face 11. Therefore, we can reduce the angle (X) thereby enlarging the reflective face 11. The angle (X) preferred to be from about 20° to about 50°.

I claim:

1. A reflective pavement marker comprising an integrally molded multisided hollow housing made of organic resinous material which has at least one side formed to be reflective face, said reflective face having an outside surface including rhombic shaped raised load bearing portions defining planar surfaces of a plurality of rhombic shaped cells, said cells adapted to intercept light from oncoming vehicles, said rhombic shaped cells each having an inside surface comprising at least one light reflecting element, said at least one element having three mutually intersecting surfaces, said inside surfaces of the rhombic shaped cells being divided by partition and load carrying walls which provide means to isolate and seal said at least one reflective element within each cell from adjacent cells, a backing sheet adhered to said partition and load carrying walls, said backing sheet made of organic resinous material, the interior of the housing being completely filled with thermosetting material and said thermosetting material supporting the backing sheet.

2. The marker of claim 1 in which the outside surface of the reflective face makes an acute angle X with the base plane, said acute angle X to be within the range of about 20° to about 50°.

3. The marker of claim 1 in which a generally horizontal base and top interconnect said reflective faces with two multi-angled sides, said sides each form two distinct angles $A_1$ and $A_2$ with the vertical planes, said angle $A_1$ having a value within the range of about 5° to about 15° and said angle $A_2$ having a value within the range of about 15° to about 60°.

4. The marker of claim 1 wherein said inside surface of each cell has a plurality of reflecting elements.

5. The marker of claim 1 in which the three mutually intersecting surfaces of said reflective elements are of the cube corner type within each cell, said cube corner being positioned such that the axis through each cube corner makes an acute angle with the normal to the outside surface of the reflective face, the size and the number of said reflective cube corner elements within each said rhombic cell is set forth by the size of the rhombic cells to be used within the inside surface of the said reflective face.

6. The marker of claim 1 in which the three mutually intersecting surfaces of said reflecting elements with at least two surfaces being perpendicular to one another.

* * * * *